US009044078B2

(12) United States Patent
Tani

(10) Patent No.: US 9,044,078 B2
(45) Date of Patent: Jun. 2, 2015

(54) COSMETIC MATERIAL APPLICATION CONTAINER

(75) Inventor: Yoshikazu Tani, Kawaguchi (JP)

(73) Assignee: TOKIWA CORPORATION, Nakatsugawa-Shi (JP)

( * ) Notice: Subject to any disclaimer, the term of this patent is extended or adjusted under 35 U.S.C. 154(b) by 797 days.

(21) Appl. No.: 13/228,706

(22) Filed: Sep. 9, 2011

(65) Prior Publication Data

US 2012/0076568 A1 Mar. 29, 2012

(30) Foreign Application Priority Data

Sep. 24, 2010 (JP) ..... 2010-213707
Oct. 22, 2010 (JP) ..... 2010-237725

(51) Int. Cl.

| | |
|---|---|
| ***B05C 17/005*** | (2006.01) |
| ***A45D 40/20*** | (2006.01) |
| ***A45D 34/04*** | (2006.01) |
| ***A45D 40/26*** | (2006.01) |

(52) U.S. Cl.

CPC ..... *A45D 40/20* (2013.01); *B05C 17/00503* (2013.01); *B05C 17/00516* (2013.01); *B05C 17/00533* (2013.01); *A45D 34/042* (2013.01); *A45D 40/262* (2013.01)

(58) Field of Classification Search

USPC ..... 401/9, 11, 261, 262, 263, 265, 266; 222/566, 575

See application file for complete search history.

(56) References Cited

U.S. PATENT DOCUMENTS

| | | | | |
|---|---|---|---|---|
| 2,246,838 | A * | 6/1941 | Castino | 132/74.5 |
| 4,887,924 | A * | 12/1989 | Green | 401/261 |
| 6,981,811 | B2 * | 1/2006 | Breidenbach et al. | 401/6 |
| 7,476,048 | B2 * | 1/2009 | Prague | 401/262 |
| 7,651,288 | B2 * | 1/2010 | Welschoff | 401/11 |

* cited by examiner

*Primary Examiner* — David Walczak
(74) *Attorney, Agent, or Firm* — Bacon & Thomas, PLLC

(57) ABSTRACT

A cosmetic material application container which can stably and easily draw a cosmetic material line, and is structured to discharge a cosmetic material in a filling region from a pen point portion formed by a soft material. A pen point portion shape is three-dimensionally formed by structuring a flat column body by a flat base end shape and a leading end shape provided closer to a leading end side than the base end shape, setting such an arcuate curve as to incline while heading for a base end side from one intersecting point between an outer edge of the leading end shape and a long axis (L2) and bulge to the leading end side, on a plane including a long axis (L1) and the long axis (L2), and cutting the flat column body by a cut surface passing through the curve.

7 Claims, 14 Drawing Sheets

COSMETIC MATERIAL APPLICATION CONTAINER

BACKGROUND OF THE INVENTION

1. Field of the Invention

The present invention relates to a cosmetic material application container which discharges a cosmetic material from a leading portion of a pen.

2. Description of the Conventional Art

As a conventional cosmetic material application container, for example, as described in Japanese Unexamined Utility Model Publication No. 61-106115, there has been known a structure in which a liquid cosmetic material filled in a filling region within a container (a shaft tube) is discharged from a tapered pen point portion having a circular shape or a polygonal shape in its cross section. This cosmetic material application container is structured such that a leading end side of the pen point portion is cut by a plane which is inclined at an optional angle with respect to an axial direction of the pen point portion. Accordingly, in this cosmetic material application container, it is intended to draw a cosmetic material line at an optional width by rotating while keeping an angle of retention of the pen point portion with respect to a subject to be applied such as a skin or the like at a fixed angle, at a time of using.

SUMMARY OF THE INVENTION

In this case, in the cosmetic material application container mentioned above, the pen point portion catches on the subject to be applied, for example, the skin or the like at a time of using, and there is a case that it becomes hard to draw the intended cosmetic material line well. Accordingly, in recent years, as a cosmetic material application container, there is desired a structure in which the cosmetic material line can be stably and easily drawn.

Consequently, an object of the present invention is to provide a cosmetic material application container which can stably and easily draw a cosmetic material line.

According to the present invention, in order to solve the problem mentioned above, there is provided a cosmetic material application container discharging a cosmetic material filled in a filling region within the container from a pen point portion formed by a soft material, wherein a shape of the pen point portion is three-dimensionally formed by constructing a flat column body by a base end shape forming a flat shape, and a leading end shape provided closer to a leading end side than the base end shape and forming a flat shape, setting such an arcuate curve as to incline while heading for a base end side from one intersecting point between an outer edge of the leading end shape and a long axis of the leading end shape and bulge to the leading end side, on a plane including a long axis of the base end shape and the long axis of the leading end shape in the column body, and cutting the column body by a cut surface passing through the curve.

Further, according to the present invention, there is provided a cosmetic material application container discharging a cosmetic material filled in a filling region within the container from a pen point portion formed by a soft material, wherein a shape of the pen point portion is three-dimensionally formed by constructing a flat column body by a base end shape forming a flat shape, and a leading end shape provided closer to a leading end side than the base end shape and forming a flat shape, setting such an arcuate curve as to incline while heading for a base end side from one intersecting point between an outer edge of the leading end shape and a long axis of the leading end shape and bulge to the leading end side, on a plane including a long axis of the base end shape and the long axis of the leading end shape in the column body, and setting a line of intersection between a cut surface passing through the curve and the column body to an outer edge of the leading end surface so as to be on the basis of the outer edge of the leading end surface and the base end shape.

In the cosmetic material application container according to the present invention mentioned above, since the pen point portion is three-dimensionally formed such that an outer shape of a transverse surface comes to a flat shape, it is possible to preferably deflect the pen point portion in a direction of the long axis. Further, since an application surface brought into contact with the subject to be applied is preferably constructed in such a manner as to come to a smooth curved shape deflecting to the leading end side, on the basis of the leading end surface of the pen point portion, it is possible to inhibit the pen point portion from catching on, for example, the subject to be applied, and the cosmetic material lines having various thicknesses can smoothly come into contact with the skin so as to be drawn well. Therefore, in accordance with the present invention, it is possible to stably and easily draw the cosmetic material line.

Further, it is preferable that a portion corresponding to one intersecting point in the leading end shape is sharper than a portion corresponding to another intersecting point between the outer edge of the leading end shape and the long axis of the leading end shape. In this case, the leading end surface of the pen point portion constructing the application surface is three-dimensionally formed in such a manner that a leading end side thereof is sharp. Accordingly, it is possible to particularly easily draw a narrow cosmetic material line.

Further, it is preferable that the column body is formed as a tapered shape by making a length of a short axis of the leading end shape shorter than a length of a short axis of the base end shape. In this case, the shape of the pen point portion can be three-dimensionally formed as the tapered shape, and it is possible to further easily draw the cosmetic material line.

Further, it is preferable that the cut surface three-dimensionally forms an elongated application surface in which a direction along an axial direction of the pen point portion is set to a longitudinal direction as seen from a direction of a long axis, and a peak is formed in a leading end of the application surface. In this case, it is possible to particularly easily draw the narrow cosmetic material line.

Further, there is a case that the pen point portion has a discharge port which is formed in a center in the leading end surface of the column body cut by the cut surface, as seen from the leading end side.

Further, according to the present invention, there is provided a cosmetic material application container discharging a cosmetic material filled in a filling region within the container from a pen point portion formed by a soft material, wherein the pen point portion is formed as an edge shape in a side view while an outer shape of a transverse surface being formed as a flat shape, a leading end surface thereof constructs an application surface, the application surface is formed as such a curved shape as to bulge to a leading end side, and a peak is formed in a leading end of the application surface.

In the cosmetic material application container according to the present invention, since the pen point portion is three-dimensionally formed in such a manner that the outer shape of the transverse cross section is formed as the flat shape, it is possible to preferably deflect the pen point portion in the direction of the long axis. Further, since the leading end surface of the pen point portion corresponding to the application surface is formed as the smooth curved shape bulging to the leading end side, it is possible to inhibit the pen point portion from catching on, for example, the subject to be applied, and it is possible to smoothly draw the cosmetic material lines having the various thicknesses with a good skin contact. Therefore, even in the present invention, it is possible to achieve the operation and effect mentioned above that the cosmetic material line can be stably and easily drawn. Further, since the peak is formed in the leading end of the application surface, it is possible to particularly easily draw the narrow cosmetic material line.

DETAILED DESCRIPTION OF PREFERRED EMBODIMENTS

Figure 1:
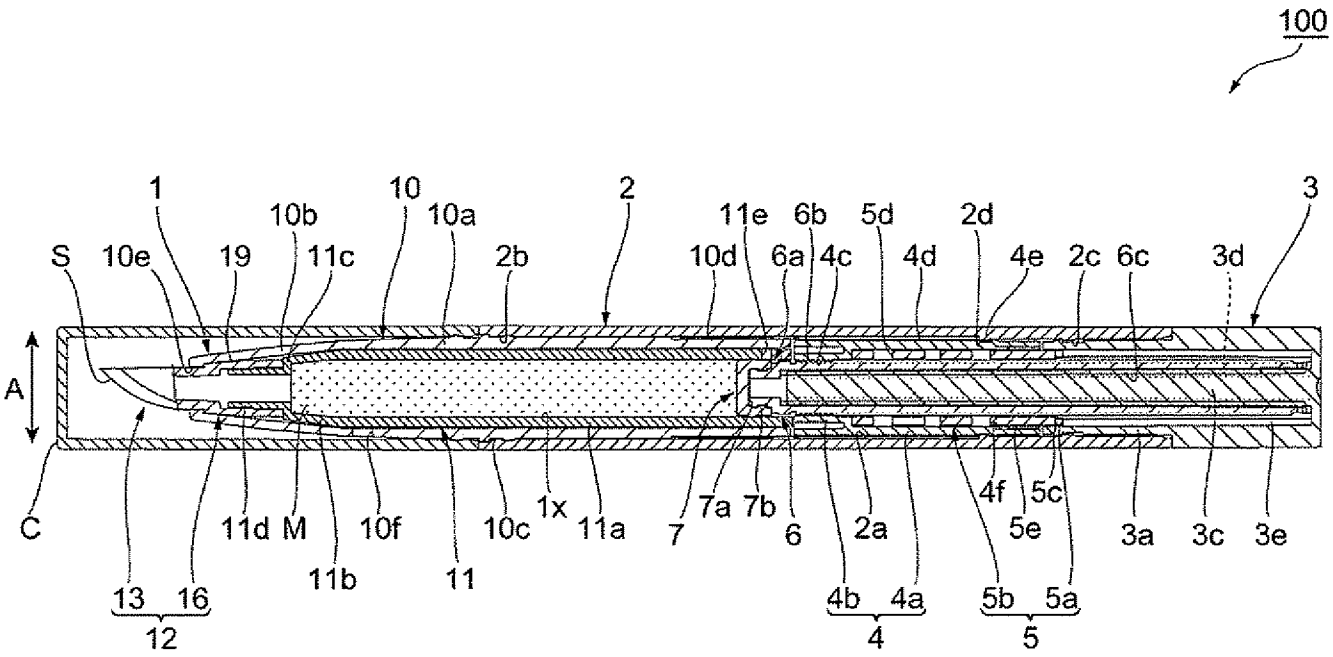
FIG. 1 is a vertical cross sectional view showing a cosmetic material application container according to an embodiment of the present invention.

A preferable embodiment according to the present invention will be described below with reference to the accompanying drawings. The same reference numerals are attached to the same or corresponding elements in the following description, and an overlapping description will be omitted.

Figure 2:
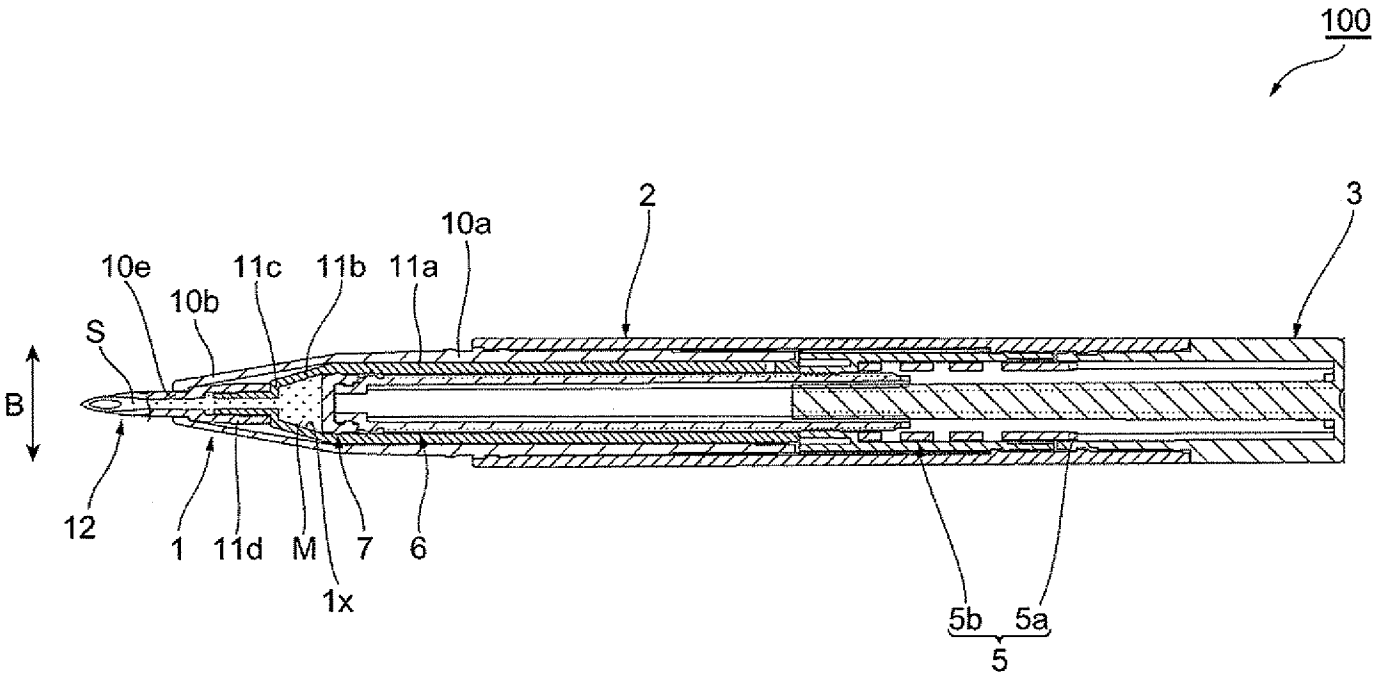
FIG. 2 is a vertical cross sectional view showing a state when a piston forward moves in the cosmetic material application container in FIG. 1.

FIG. 1 is a vertical cross sectional view showing a cosmetic material application container according to an embodiment of the present invention. FIG. 2 is a vertical cross sectional view showing state when a piston forward moves in the cosmetic material application container in FIG. 1. As shown in FIG. 1, a cosmetic material application container 100 according to the present embodiment is structured such as to appropriately discharge (extrude) a cosmetic material M filled in an inner portion thereof by an operation of a user.

It is possible to employ various cosmetic materials such as an eye liner, an eyebrow, a lip liner, an eye shadow, a body paint, an enamel, a lip gloss, an eye color, a cheek color, a concealer, a hair color and the like. It is particularly suitable to employ a very soft material (a gel state, a semisolid state, a soft state, a jelly state, a moose state, a plaster state including them and the like). Further, it is possible to enhance a long lasting characteristic by blending a volatile solvent (for example, a silicone oil such as a cyclopentasiloxane or the like, and a hydrocarbon oil such as an isododecane, an isohexadecane or the like) in addition to a pigment, a cosmetic material oil solution, a wax or the like, as the cosmetic material M.

Further, the cosmetic material M can employ a material from a low viscosity to a high viscosity, and particularly preferably employs a cosmetic material M having a hardness between about 0.1 N and 0.2 N. The hardness of the cosmetic material M is determined in accordance with a general measuring method which is used for measuring a hardness in a cosmetic. In this case, a hardness (a penetration number) is set to a force (a strength) at a peak time generated in the cosmetic material M in the case of using, for example, FUDOH RHEO METER [RTC-2002D.D] (manufactured by LEOTECH company) as a measuring device, and inserting a steel bar of ϕ3 mm to the cosmetic material M at a speed of 6 cm/min by a depth of about 10 mm under a condition of an ambient temperature of 25° C.

As shown in FIGS. 1 and 2, the cosmetic material application container 100 is provided as an outer structure with a filling member 1 corresponding to a leading tube which is provided in an inner portion with a filling region 1*x* filled with a cosmetic material M, a main body tube 2 engaging the filling member 1 in an axial direction (a back and forth direction) and a rotating direction around an axis (hereinafter, refer simply to as "rotating direction") by inward inserting a rear half portion of the filling member 1 to a front half portion thereof and connecting so as to integrate, and an operation tube 3 connected in an axial direction to a rear end portion of the main body tube 2 while being relatively rotatable. In this case, "axis" means a center line extending to back and forth sides of the cosmetic material application container 100 ("axis" described hereinafter has the same meaning).

The cosmetic material application container 100 is schematically provided in an inner portion thereof with a moving body 6 which moves in an axial direction on the basis of a relative rotation between the main body tube 2 (or the filling member 1) and the operation tube 3, a piston 7 which is installed to a front end (a leading end) portion of the moving body 6 so as to form a rear end of the filling region 1*x*, a thread tube 4 serving as an thread engagement portion which can achieve a movement of the moving body 6 on the basis of the relative rotation, and a click mechanism 5 which applies a click feeling in synchronous with the relative rotation.

The main body tube 2 is constructed as a cylindrical shape, and has a knurling 2*a* which is provided side by side with a lot of concavo-convex shapes in a peripheral direction and the concavo-convex shapes extending at a predetermined length in an axial direction, as an element for engaging the filling member 1 and the thread tube 4 in a rotating direction, in an inner peripheral surface of a center portion in an axial direction thereof. Further, an inner peripheral surface of a leading end portion of the main body tube 2 is provided with an annular protruding portion 2*b* for engaging the filling member 1 in an axial direction. In an inner peripheral surface in a rear portion side of the main body tube 2, a protruding portion 2*c* extending along a peripheral direction is formed as an element for engaging the operation tube 3 in an axial direction. Further, in a front side closer to the protruding portion 2*c* in the inner peripheral surface of the main body tube 2, a protruding portion 2*d* extending along a peripheral direction is formed as an element for engaging the thread tube 4 in an axial direction.

The operation tube 3 is constructed as a closed-end cylindrical shape, and is provided with a front end tube portion 3*a* in which an outer diameter is made smaller in a front end side thereof, and an outer peripheral surface of the front end tube portion 3*a* is provided with an annular groove portion 3*b* for engaging with the protruding portion 2*c* of the main body tube 2 in an axial direction. Further, the operation tube 3 is provided in a rising manner with a shaft body 3*c* in a center of a bottom portion thereof. The shaft body 3*c* is formed as a noncircular shape in a transverse cross section while having a plurality of protruding stripes 3*d* extending in an axial direction on an outer peripheral surface of a circular column body, and the protruding strip 3*d* constructs one of a rotation preventing portion of the moving body 6.

Further, the operation tube 3 is provided in an inner peripheral surface thereof with protruding stripes 3*e* extending toward a leading end side from a bottom portion at eight uniformly arranged positions along a peripheral direction. A leading end portion 5*a* of the protruding stripe 3*e* is set to an engagement portion constructing the click mechanism 5. The operation tube 3 is inward inserted to the main body tube 2 from the front end tube portion 3*a* thereof, and the annular groove portion 3*b* thereof engages with the protruding portion 2*c* of the main body tube 2, thereby being connected and installed in the axial direction while being relatively rotatable with respect to the main body tube 2.

The thread tube 4 is provided with an outer tubular body 4*a* forming an outer cylindrical shape, and an inner tubular body 4*b* provided in a leading end portion of the outer tubular body 4*a* and forming an inner cylindrical shape. An inner peripheral surface of the inner tubular body 4*b* is provided with a female thread 4*c* constructing one of the engagement portions. In an outer peripheral surface of the outer tubular body 4*a*, protruding strips 4*d* for engaging with the knurling 2*a* of the main body tube 2 in a rotating direction are formed at a plurality of positions in a peripheral direction, and an annular groove portion 4*e* for engaging with the protruding portion 2*d* of the main body tube 2 in an axial direction are formed at a position closer to a rear end surface.

Further, a plurality of concave portions 4*f* extending in an axial direction are provided along a peripheral direction, as an element engaging a click spring member 5*b* of the click mechanism 5 in a rotating direction, in a rear end portion in an inner peripheral surface of the outer tubular body 4*a*. The thread tube 4 is inward inserted to the main body tube 2 from a rear end portion thereof, and is installed to the main body tube 2 in such a manner as to engage and integrate with the main body tube 2 in an axial direction and a rotating direction, on the basis of an engagement of the annular groove portion 4*e* with the protruding portion 2*d* of the main body tube 2, and an engagement of the protruding stripe 4*d* with the knurling 2*a* of the main body tube 2.

The click spring member 5*b* is formed as an injection molded product by a resin, and is constructed as an approximately cylindrical shape. A rear end surface of the click spring member 5*b* is provided with a plurality of click teeth 5*c* engaging with the leading end portion 5*a* of the protruding strip 3*e* of the operation tube 3 along a peripheral direction. An approximately spiral slit 5*d* is formed in a peripheral wall of the click spring member 5*b*, whereby the click spring member 5*b* serves as a compression spring portion biasing the click teeth 5*c* rearward. Further, an outer peripheral surface of a rear end portion of the click spring member 5*b* is provided with a plurality of protruding strips 5*e* extending in an axial direction along a peripheral direction, on an outer peripheral surface of a rear end portion of click spring member 5*b*.

The click spring member 5*b* is accommodated in the thread tube 4 in such a manner that a front end surface is brought into contact with a rear end surface of the inner tubular body 4*b* of the thread tube 4, and the protruding strip 5*e* engages with the concave portion 4*f* of the thread tube 4, thereby engaging in a rotating direction with respect to the thread tube 4. Further, in this state, the click spring member 5*b* is pinched in an axial direction by the protruding strips 3*e* of the operation tube 3, whereby the click teeth 12*a* is biased in a rearward side, and comes to a click engagement state with respect to the leading end portion 3*f* of the protruding strip 3*e* of the operation tube 3.

The moving body 6 is structured as a cylindrical shape, and is provided in an outer peripheral surface running into a rear end portion from a rear side of a front end portion 6*a* with a male screw 6*b* constructing another of the engagement portion. Further, protruding strips 6*c* arranged in such a manner as to protrude radially to an inner side and extending in an axial direction are provided at six uniformly arranged positions along a peripheral direction, in an inner peripheral surface of the moving body 6, and the protruding strips 6*c* structure the other rotation preventing portion of the moving body 6. The moving body 6 is inward inserted to the inner tubular body 4*b* of the thread tube 4 as well as being outward inserted to the shaft body 3*c* of the operation tube 3, and the male screw 6*b* is engaged with the female thread 4*c* of the thread tube 4. In conjunction with this, the moving body 6 engages between the protruding strips 3*d* and 3*d* of the shaft body 3*c* in the protruding strip 6*c* thereof, and is engaged with and installed to the operation tube 3 in the rotating direction while being movable in the axial direction.

The piston 7 is formed by a polypropylene (PP) having a different color tone (for example, a white color) from a color tone of the cosmetic material M, a high density polyethylene (HDPE), a linear low density polyethylene (LLDPE) or the like, and has a concave portion 7*a* which is provided in a concave manner in a rear end surface thereof. An inner peripheral surface of the concave portion 7*a* is provided with an annular protruding portion 7*b* which engages while being movable only at a predetermined length in an axial direction with respect to the moving body 6. The piston 7 is outward inserted to the front end portion 6*a* of the moving body 6, and the annular protruding portion 7*b* thereof engages with the moving body 6 in an axial direction, thereby being installed while being movable in the axial direction (movable within a predetermined range) with respect to the moving body 6.

The filling member 1 is formed by an injection molded plastic, for example, a polyethylene terephthalate (PET), a polypropylene (PP) or the like, and is constructed while including an outer filling tube 10 constructing an outer periphery, an inner filling tube 11 defining the filling region 1*x* in an inner side of the outer filling tube 10, and a pen point member 12 constructing a leading end portion of the filling member 1 and provided for applying the cosmetic material M.

The outer filling tube 10 has a cylindrical main body portion 10*a* and a taper portion 10*b* which is successive with a front side of the main body portion 10*a*. The main body portion 10*a* has an annular concave portion 10*c* engaging with the annular protruding portion 2*b* of the main body tube 2 in an axial direction, in an axial direction center on an outer peripheral surface thereof. A lot of concavo-convex shapes are provided side by side in a peripheral direction and a knurling 10*d* in which the concavo-convex shapes extend at a predetermined length in an axial direction is provided, as an element which engages with the knurling 2*a* of the main body tube 2 in a rotating direction, in a rear end portion in an outer peripheral surface of the main body portion 10*a*.

The taper portion 10*b* is formed as a tapered frustum shape and is formed as a flat circular shape in an outer shape of a transverse cross section. An opening 10*e* having a flat circular shape in a cross section is formed in a front end portion of the taper portion 10*b*. In the taper portion 10*b*, one direction A (a vertical direction in FIG. 1) which is orthogonal to an axial direction is set to a direction of a long axis, and another direction B (a vertical direction in FIG. 2) which is orthogonal to the axial direction and the one direction is set to a direction of a short axis. Further, the taper portion 10*b* has a window 10*f* constructed by a through hole which passes through a peripheral wall of a rear end portion thereof in a circular cross section, as an element for checking out a color tone and an existence (a filling degree) of the cosmetic material M.

The inner filling tube 11 is formed by a transparent material, and has such a permeability that the cosmetic material M in the filling region 1*x* in an inner portion thereof can be seen through. The inner filling tube 11 has a cylindrical main body portion 11*a*, a taper portion 11*b* which is successive with a front side of the main body portion 11*a*, and a front end portion 11*d* which is successive with a front side of the taper portion 11*b* via a step 11*c*. The main body portion 11*a* has an air discharge hole 11*e* constructed by a through hole passing through a peripheral wall of a rear end portion thereof by a circular cross section, as a structure for discharging the air within the filling region 1*x* to an external portion at a time of assembling.

The taper portion 11*b* is formed as a tapered frustum tubular shape, and an outer shape of a transverse cross section is formed as a flat circular shape. The front end portion 11*d* is formed as a tubular shape, and an outer shape of a transverse cross section is formed as a flat circular shape. In the taper portion 11*b* and the front end portion 11*d*, the one direction A is set to a direction of a long axis, and the another direction B is set to a direction of a short axis. The inner filling tube 11 is inward inserted and installed to the outer filling tube 10. In this case, in the following description, the one direction A is called as the long axis direction A, and the another direction B is called as the short axis direction B.

FIGS. 3 to 6 are respective views showing a pen point member in the cosmetic material application container in FIG. 1. As shown in FIGS. 3 to 6, in the filling member 1 according to the present embodiment, as mentioned above, the pen point member 12 formed by a soft material is provided as a structure applying the cosmetic material M. As the soft material, for example, there can be employed a thermosetting general rubber which is heated and molded by a vulcanization, and a thermoplastic elastomer which is one kind of the plastic and is molded by plasticizing by a heat and flowing into a metal mold.

As the general rubber, there can be mainly listed up a nitrile rubber (NBR), a butyl rubber (IIR), an ethylene propylene rubber (EPDM), and a silicone rubber (Si). Further, as the thermoplastic elastomer, there can be mainly listed up a polyester elastomer (TPEE), an olefin elastomer (TPO), and an urethane elastomer (TPU). Among them, in the urethane elastomer, it is possible to employ any of two kinds in which a hard segment is a polyurethane and a soft segment is a polyester type or a polyether type, and the material in which the soft segment is of the polyester type is particularly suitable to the cosmetic material M.

The pen point member 12 is preferably structured such that a hardness by a type A durometer defined by JIS K 6253 is set to 60±20. The pen point member 12 includes a pen point (a pen point portion) 13 which is sharp to a leading end side, and a base end portion 16 which is successive with a base end side of the pen point 13 via a step 14.

The pen point 13 is formed as an edge shape in a side view as well as being formed as a flat circle in an outer shape of a transverse cross section, and is formed as a sharp shape in which one side (an upper side in FIG. 3) in the long axis direction A of the transverse cross section is sharpened at an acute angle. In this pen point 13, an application surface S which is brought into contact with a subject to be applied such as a skin or the like of a user is constructed by a leading end surface thereof.

The application surface S is formed as such a curved surface as to extend straight in the short axis direction B of the transverse cross section of the pen point 13 as well as bulging to a leading end side, and a peak P is formed in a leading end thereof. Specifically, in a side view (a view in the short axis direction B), the application surface S is formed as a curved surface extending to a base end of the pen point 13 so as to bulge to a leading end side while inclining toward a base end side (a rear side) from the peak P constructing a sharp portion of a leading end of the pen point 13. An inclination angle with respect to a direction of an axis G in the application surface S becomes smaller in accordance with coming to a base end side. The application surface S is formed as a flat circular shape which is elongated in a direction along the direction of the axis G, as seen from the long axis direction A (refer to FIG. 4B). In other words, the application surface S has an elongated surface shape in front and rear sides thereof.

Further, a taper surface 17 which is inclined so as to be tapered to the application surface S side is formed in a region running into the base end side at a predetermined length from an outer edge of the application surface S in both side surfaces of the pen point 13. A through hole 18 extending along the direction of the axis G and having a circular cross sectional shape is formed at a position of the axis G of the pen point 13. An opening portion of the application surface S in the through hole 18 constructs a discharge port 18*a* for discharging the cosmetic material M.

Figure 4A:
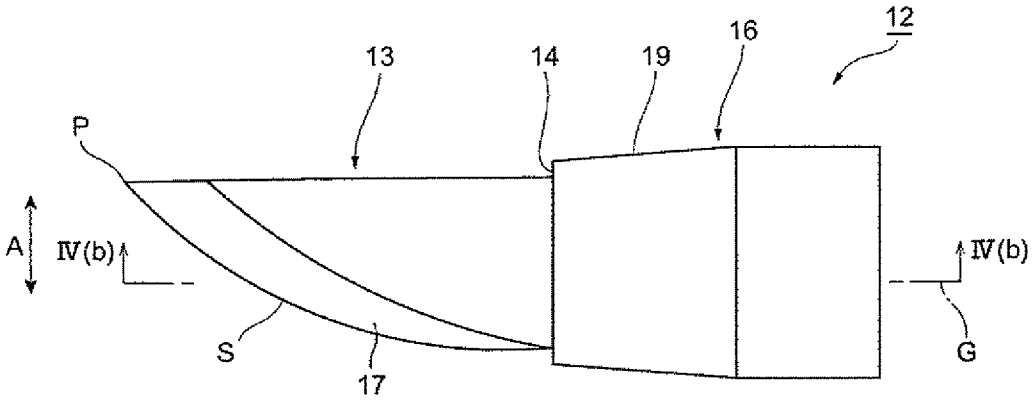
FIG. 4A is a side elevational view of the pen point member in FIG. 3.
Figure 4B:
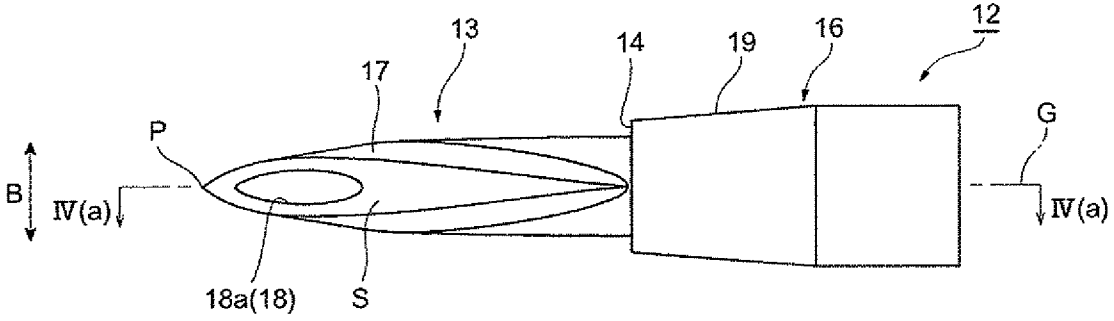
FIG. 4B is a bottom elevational view of the pen point member in FIG. 3.
Figure 5A:
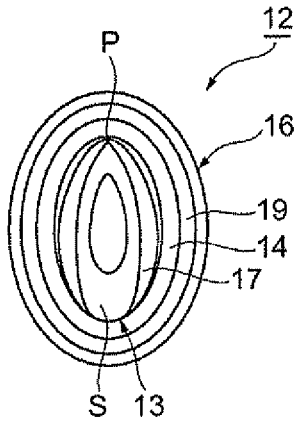
FIG. 5A is a front elevational view of the pen point member in FIG. 3.
Figure 5B:
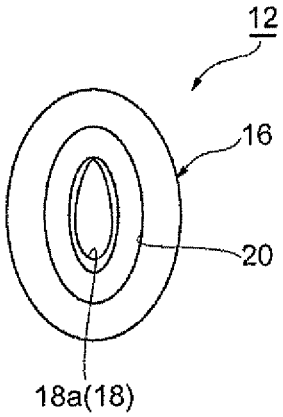
FIG. 5B is a back elevational view of the pen point member in FIG. 3.
Figure 6A:
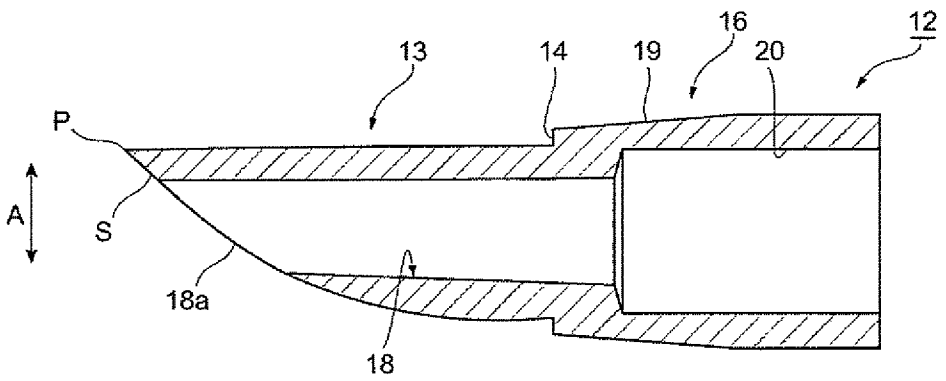
FIG. 6A is a cross sectional view along a line VI(a)-VI(a) in FIG. 4B.
Figure 6B:
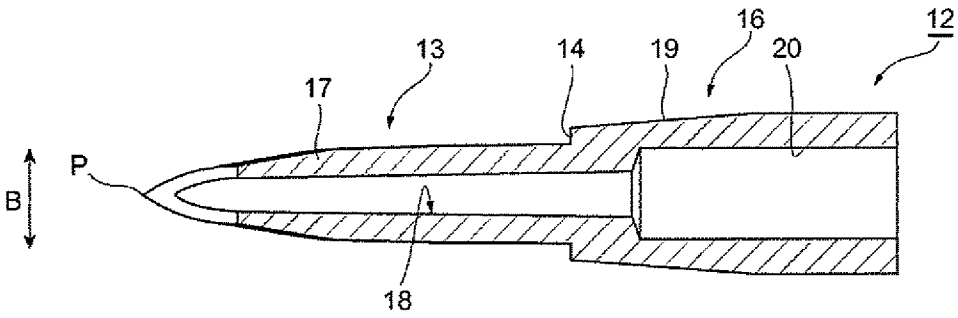
FIG. 6B is a cross sectional view along a line VI(b)-VI(b) in FIG. 4A.

The discharge port 18*a* is formed at a center position of the application surface S as seen from a leading end side (the direction of the axis G), and is formed as such a drop shape in which another side in the long axis direction bulges (refer to FIG. 5A). Further, the discharge port 18*a* is formed as a flat circular shape (an ellipse) along the application surface S, as seen from the long axis direction A (refer to FIG. 4B).

The base end portion 16 is formed as a tubular shape, and an outer shape of a transverse cross section thereof is formed as a flat circular shape having a larger diameter than the pen point 13. In a region running into a center from a front end in an outer peripheral surface of the base end portion 16, a taper surface 19 inclining so as to be tapered is formed as a structure engaging with the taper portion 10*b* of the outer filling tube 10. A tube hole 20 of the base end portion 16 is formed larger in diameter than the through hole 18, and extends along the direction of the axis G in such a manner as to be communicated with the through hole 18.

Figure 3:
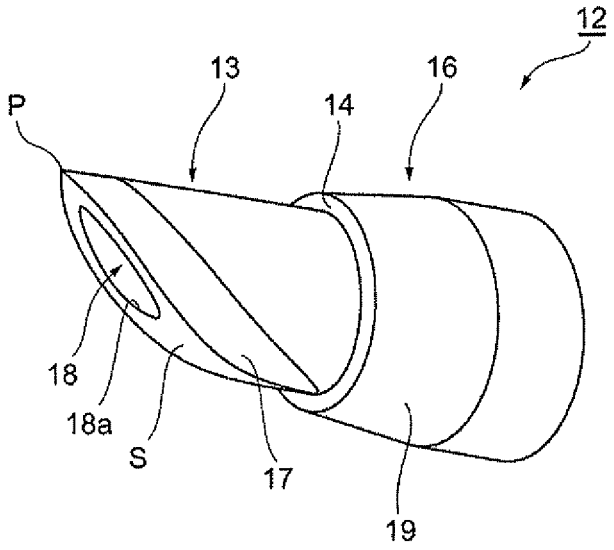
FIG. 3 is a perspective view showing a pen point member in the cosmetic material application container in FIG. 1.

As shown in FIGS. 1 and 3, the pen point member 12 is engaged and installed in a rotating direction with the outer filling tube 10, by that the pen point 13 is inward inserted to the opening 10*e* of the outer filling tube 10. Further, the tube hole 20 of the base end portion 16 is outward inserted to the front end portion 11*d* of the inner filling tube 11, thereby being engaged and closely attached in the rotating direction with the inner filling tube 11. At this time, the pen point member 12 is engaged in an axial direction with a front end portion of the taper portion 10*b* of the outer filling tube 10 in its step 14, and a rear end surface of the base end portion 16 is engaged in the axial direction with the step 11*c* of the inner filling tube 11, thereby being pinched and retained in the axial direction by the outer filling tube 10 and the inner filling tube 11.

In the filling member 1 provided with the outer filling tube 10, the inner filling tube 11 and the pen point member 12 mentioned above, the cosmetic material M is filled by plugging the inner filling tube 11 in a leading end side so as to close and injecting the cosmetic material M to the filling region 1*x* from a rear side, thereafter detaching the plug, and assembling the inner filling tube 11 in the outer filling tube 10 to which the pen point member 12 is installed.

Further, in the filling member 1 filled with the cosmetic material M, it is inward inserted to the main body tube 2 from the rear portion side, the annular concave portion 10*c* of the outer filling tube 10 engages with the annular protruding portion 2*b* of the main body tube 2, and the knurling 10*d* of the outer filling tube 10 engages with the knurling 2*a* of the main body tube 2, thereby being engaged with and installed to the main body tube 2 in the axial direction and the rotating direction, and being integrated with the main body tube 2.

In conjunction with this, the filling member 1 is inward inserted and installed to a rear end portion of the inner filling tube 11 in such a manner that the piston 7 comes into close contact in an airtight manner. At this time, as mentioned above, since the air discharge hole 11*e* is provided in a rear end portion of the inner filling tube 11, it is possible to moderately let out the air from a portion between the cosmetic material M within the filling region 1*x* and the piston 7 via the air discharge hole 11*e*, even in the case that the air exists therebetween, and it is possible to inhibit an internal pressure of the filling region 1*x* from being increased. Further, a cap C is attached to the filling member 1 from a leading end side thereof.

Next, a description will be given of a case (a method) of three-dimensionally forming a shape of the pen point 13 in the pen point member 12 mentioned above. In this case, in the description here, a description will be given of an embodiment in which a taper surface 17 is not formed in the pen point 13.

FIGS. 7 to 10 are views for explaining the three-dimensional formation of the shape of the pen point. In the present embodiment, at a time of three-dimensionally forming the shape of the pen point 13, a surface type computer aided design (CAD) is preferably used, for example, a rhinoceros (a software manufactured by RobertMcNeel & Associates) is employed.

Figure 7:
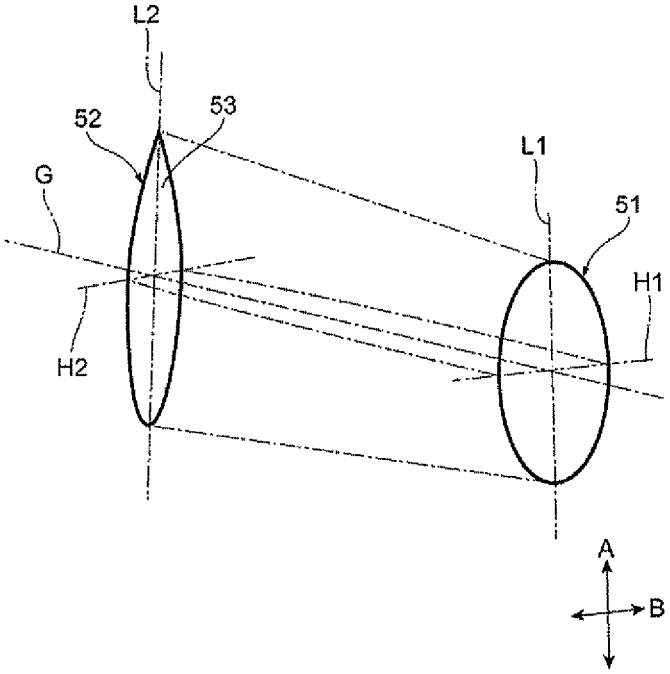
FIG. 7 is a view for explaining a three-dimensional shape of a pen point shape.

First of all, as shown in FIG. 7, a flat base end shape 51 having a long axis L1 and a short axis H1 and deforming a circular shape flat toward a center is drawn at a position corresponding to a base end (an illustrated right side) in the direction of the axis G of the pen point 13. Subsequently, a flat leading end shape 52 being in parallel to the base end shape 51, having a long axis L2 and a short axis H2 and deforming a circular shape flat toward a center is drawn at a position which is spaced at a fixed distance to a leading end side (an illustrated left side) in the direction of the axis G with respect to the base end shape 51.

At this time, a direction of the long axis L1 of the base end shape 51 and a direction of the long axis L2 of the leading end shape 52 are made equal to each other, and are set to the long axis direction A in this case. Further, a direction of the short axis H1 of the base end shape 51 and a direction of the short axis H2 of the leading end shape 52 are made equal to each other, and are set to the short axis direction B in this case. Long diameters of the base end shape 51 and the leading end shape 52 (lengths of the long axes L1 and L2) are made approximately equal to each other. On the other hand, a short diameter of the leading end shape 52 (a length of the short axis H2) is made shorter than a short diameter of the base end shape 51 (a length of the short axis H1).

Further, the base end shape 51 is formed as an oval shape, and the leading end shape 52 forms a sharp portion 53 corresponding to a corner portion which is sharpened at an acute angle rather than another side in the long axis direction A, in one side in the long axis direction A. In this case, a fixed distance at which the base end shape 51 and the leading end shape 52 are spaced is set to a distance corresponding to the length in the direction of the axis G of the pen point 13.

Figure 8:
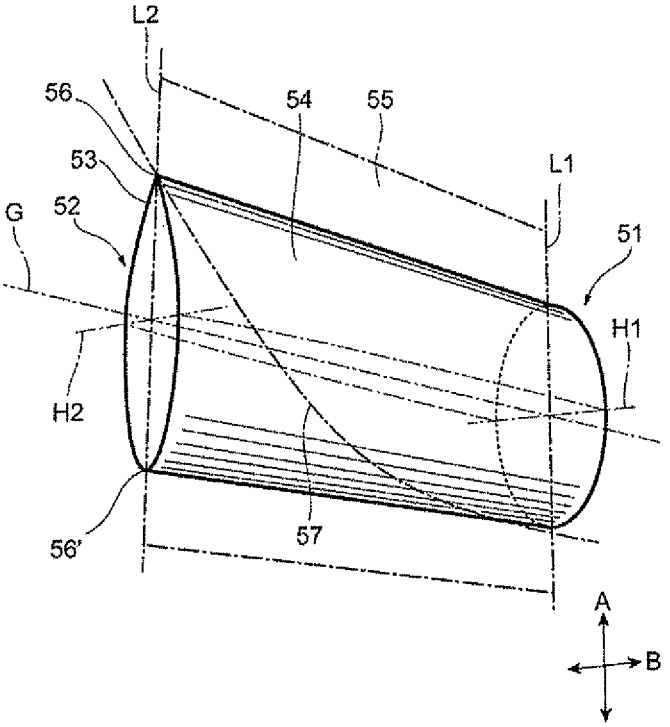
FIG. 8 is a view showing a subsequence of FIG. 7.

Subsequently, as shown in FIG. 8, on the basis of the base end shape 51 and the leading end shape 52, a tapered flat circular column (a flat column body) 54 having them as end faces is constructed. Further, there is set an arcuate curve 57 which is inclined toward the base end side and bulges to the leading end side, from one intersecting point 56 between an outer edge of the leading end shape 52 and the long axis L2, on a plane 55 including the long axes L1 and L2.

Specifically, there is drawn the arcuate curve 57 extending while bulging so as to become convex to a leading end side as well as inclining toward the base end side, in which an end of the sharp portion 53 of the leading end shape 52 passes through one intersecting point 56 intersecting the long axis L2, on the plane 55, in such a manner as to pass through the base end side close to the side surface of the flat circular column 54. The curve 57 in this case is drawn by a free curve in which a curvature changes little by little, and the free curve is structured such that a radius of curvature becomes smaller little by little from the leading end side toward the center, and a radius of curvature becomes larger little by little from the center toward the base end side.

Figure 9:
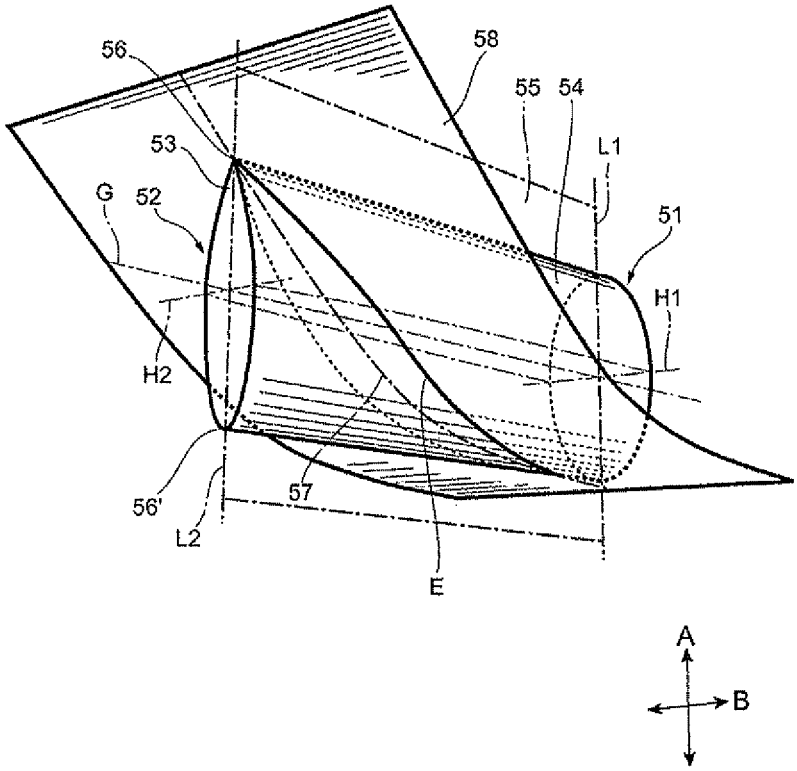
FIG. 9 is a view showing a subsequence of FIG. 8.
Figure 10:
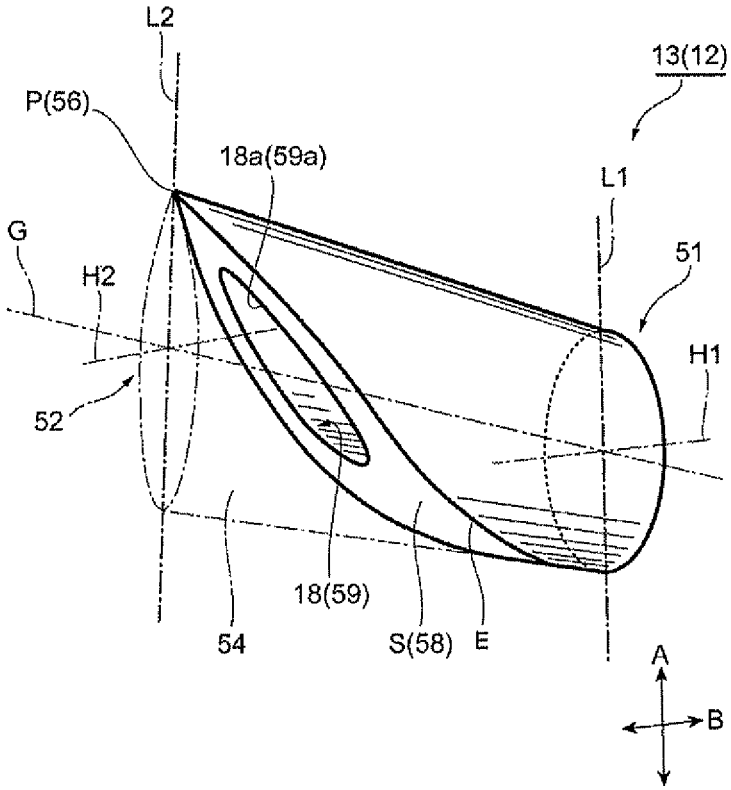
FIG. 10 is a view showing a subsequence of FIG. 9.

Subsequently, as shown in FIG. 9, the flat circular column 54 is cut by a cut surface 58 which passes through the curve 57 and extends in the direction of the short axes H1 and H2. In other words, the flat circular column 54 is cut by the cut surface 58 formed by protruding the curve 57 respectively to one side and another side in a side direction (a normal direction of the plane 55) on the basis of the plane 55. Accordingly, an intersecting line between the flat circular column 54 and the cut surface 58 (that is, a visible outline of a surface in which the flat circular column 54 intersects the cut surface 58) comes to a leading end surface outer edge E. Further, as shown in FIG. 10, a through hole 59 having a circular cross section is provided along the direction of the axis G in such a manner as to connect a center of the base end shape 51 and a center of the leading end shape 52, and an opening 59*a* is provided in a center of a leading end surface of the flat circular column 54 which is cut by the cut surface 58, as seen from the direction of the axis G.

In accordance with the above, the pen point 13 which is formed as an edge shape in a side view and has a flat circular outer shape in a transverse cross section is three-dimensionally formed. Further, the application surface S is constructed by the leading end surface of the flat circular column 54 which is cut by the cut surface 58, the peak P is structured by one intersecting point 56, and the discharge port 18*a* is structured by the opening 59*a*.

In this connection, the pen point 13 having the taper surface 17 can be three-dimensionally formed, for example, in the following manner. In other words, first of all, an intermediate shape (an intermediate flat circle) in which a flatness of the fiat base end shape 51 is increased further is drawn between the base end shape 51 and the leading end shape 52, and an intermediate flat circular column (a flat column body) is structured by the base end shape 51 and the intermediate shape. Subsequently, on the plane 55, an arcuate curve which is inclined while heading for the base end side and bulges to the leading end side, from one intersecting point between an outer edge of the intermediate shape and a long axis of the intermediate shape is drawn in such a manner as to pass through the base end side of the side surface of the intermediate flat circular column. Subsequently, the intermediate flat circular column is cut by an intermediate cut surface which passes through the curve and extends in the direction of the short axes H1 and H2, whereby a pen point intermediate body 54' (refer to FIG. 11) is three-dimensionally formed, and an intersecting line between the intermediate cut surface and the intermediate flat circular column comes to an intermediate cut surface outer edge E' (refer to FIG. 11). Further, the pen point 13 is three-dimensionally formed by creating a surface between the intermediate cut surface outer edge E' and the leading end surface outer edge E of the flat circular column 54 which is cut by the cut surface 58 in the three-dimensional formation mentioned above.

Figure 11A:
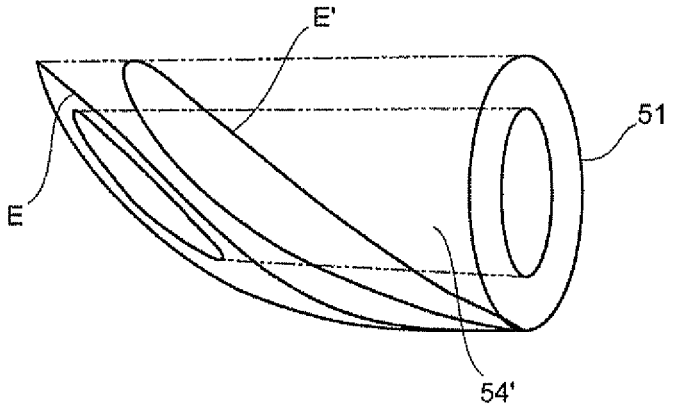
FIG. 11A is a view for explaining another embodiment of the three-dimensional formation of the shape of the pen point.
Figure 11B:
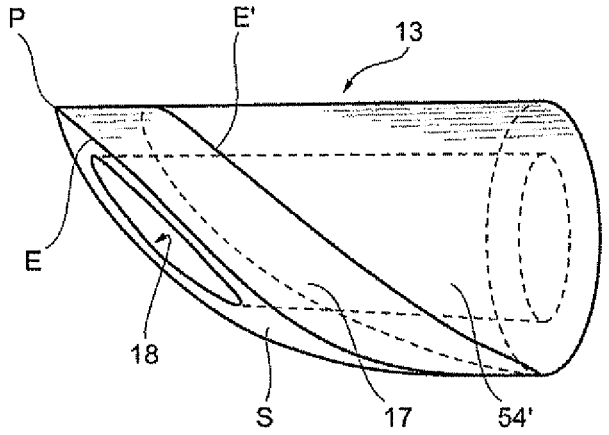
FIG. 11B is a view showing a subsequence of FIG. 11A.

Alternatively, as shown in FIGS. 11A and 11B, the pen point 13 may be three-dimensionally formed by creating the surface among the pen point intermediate body 54', the taper surface 17 and the application surface S, by means of a guide curve connecting the base end shape 51, the intermediate cut surface outer edge E' and the leading end surface outer edge E on the basis of them, on a space.

In the cosmetic material application container 100 which is structured as mentioned above and is in the initial state shown in FIG. 1, if the cap C (refer to FIG. 1) is detached by the user, and the main body tube 2 and the operation tube 3 are relatively rotated in one direction corresponding to a feeding direction or the other direction corresponding to a feedback direction, the moving body 6 and the piston 7 move forward or move backward on the basis of a cooperation of the engagement portion structured by the female thread 4*c* of the thread tube 4 and the male screw 6*b* of the moving body 6, and the rotation preventing portion structured by the protruding strip 3*d* of the operation tube 3 and the protruding strip 6*c* of the moving body 6.

At this time, since the leading end portion 5*a* of the protruding strip 3*e* of the operation tube 3 and the click teeth 5*c* of the click spring member 5*b* energized to the leading end portion 5*a* side repeat a click engagement, in accordance with a relative rotation, and a click feeling is applied to the user, it is possible for the user to detect a forward moving degree and a backward moving degree of the moving body 6 and an amount of rotation of a relative rotation on the basis of the click feeling. In the click mechanism 5 mentioned above, it is possible to regulate a distance on the basis of the number of the click teeth 5*c*, and it is possible to employ a ratchet teeth which prevents the feedback, or it is possible to employ such a structure that can feed back only at a fixed amount at an optional position.

Figure 12:
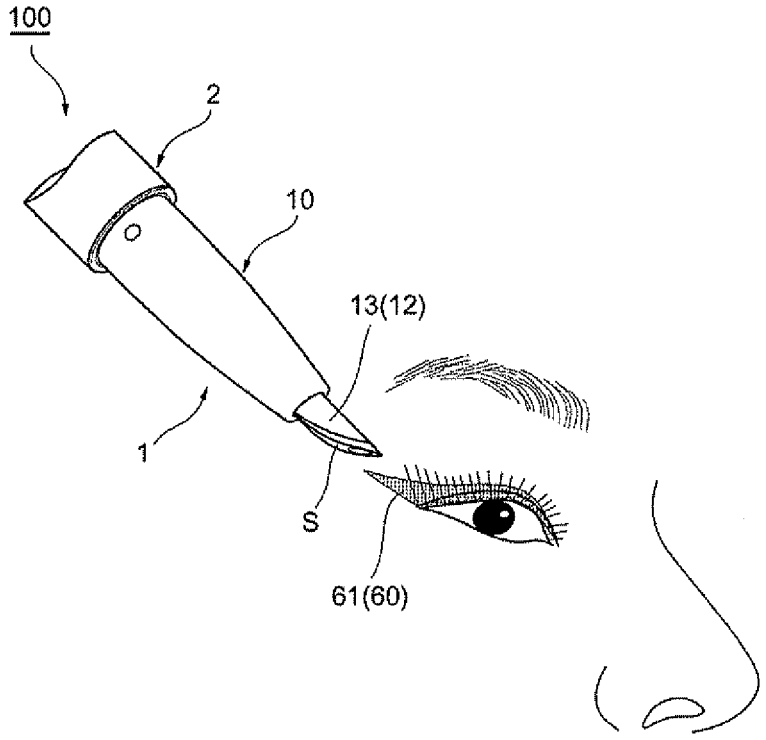
FIG. 12 is a view for explaining an example of use of the cosmetic material application container in FIG. 1.

Further, as shown in FIG. 2, if the moving body 6 and the piston 7 are moved forward, the cosmetic material M filled in the filling region 1*x* of the filling member 1 is discharged out of the discharge port 18*a* of the pen leading member 12. The user draws a cosmetic material line 61 by applying the application surface S of the pen point 13 to a subject 60 to be applied such as an edge of an eye or the like, as shown in FIG. 12 under this state.

As mentioned above, in the present embodiment, since the pen point 13 is three-dimensionally formed such that the outer shape of the transverse cross section comes to the flat circle, it is possible to preferably deflect the pen point 13 in the long axis direction A (set to a state having an elastic force and being easily restored). Further, since the application surface S is preferably structured by the leading end surface of the pen point 13 in such a manner as to form a smooth curved shape bulging to the leading end side, the cosmetic material lines 61 having the various thicknesses can be smoothly drawn with a good skin contact as well as it is possible to inhibit the pen point 13 from catching on, for example, the subject 60 to be applied. Therefore, according to the cosmetic material application container 100 of the present embodiment, it is possible to stably and easily draw the cosmetic material line 61.

Further, if the pen point 13 deflects in the long axis direction A as mentioned above, the discharge port 18*a* is compressed and deformed in the short axis direction B, and the cosmetic material M is discharged little by little from the compressed and deformed discharge port 18*a*. Accordingly, it is possible to draw the narrow and long cosmetic material line 61 without running short of a liquid (skipping), at a time of applying the cosmetic material M to the subject 60 to be applied.

Further, as mentioned above, a portion corresponding to one intersecting point 56 in the leading end shape 52 is formed as the sharp portion 53 serving as a corner portion sharpening at an acute angle at a time of three-dimensionally forming the pen point 13, and is shaper than a portion corresponding to the another intersecting point 56' (refer to FIG. 8) between the outer edge of the leading end shape 52 and the long axis L2. Accordingly, it is possible to three dimensionally form the leading end side of the application surface S in such a manner as to become sharp so as to form the peak P on the application surface S. As a result, it is possible to easily draw particularly the narrow cosmetic material line 61.

Further, as mentioned above, at a time of three-dimensionally forming the pen point 13, the length of the short axis H2 is made shorter than the length of the short axis H1, and the flat circular column 54 is formed as the tapered shape. Accordingly, it is possible to three-dimensionally form the shape of the pen point 13 by the tapered shape, and it is possible to further easily draw the cosmetic material line 61.

Further, as mentioned above, the application surface S which is three-dimensionally formed by cutting the flat circular column 54 by the cut surface 58 is formed as the elongated flat circular shape in which the direction along the direction of the axis G is set to the longitudinal direction, as seen from the long axis direction A, and the peak P is formed in the leading end thereof. Accordingly, it is possible to further easily draw the narrow cosmetic material line 61.

Further, as mentioned above, in the present embodiment, the inner filling tube 11 has the permeability and the window 10*f* is provided in the outer filling tube 10. Therefore, it is possible to check out the color tone and the existence (the filling degree) of the cosmetic material M via the window 10*f*, at a time of detaching the cap C, for example, for selling or using. Further, as mentioned above, since the piston 7 is formed by the different color tone from the cosmetic material M, the color tone appearing from the window 10*f* is changed from the color tone of the cosmetic material M to the color tone of the piston 7 if the piston 7 moves forward in accordance with the use of the cosmetic material M and the piston 7 reaches a position facing from the window 10*f*. Therefore, it is possible to check out that the remaining amount of the cosmetic material M is reduced. In this case, the change of the color tone mentioned above can be used as a sign for a finish.

Further, as mentioned above, the pen point 13 according to the present embodiment has the taper surfaces 17 in both side surfaces thereof, and is structured, as shown in FIG. 4B, such as to be particularly tapered in the leading end side thereof in place of being tapered at a fixed angle of incline in the short axis direction B. As a result, it is possible to enhance a rigidity of the pen point 13 by maintain a thickness in the base end side of the pen point 13.

The cosmetic material M such as the gel state eye liner or the like is generally filled in a jar type container and is frequently applied by separately using a cosmetic material brush. In the jar type container mentioned above, there is a risk that a volatilization is early due to its wide opening and a component tends to be changed, and there is a risk that a brush point of the cosmetic material brush solidifies so hard to be used. In this regard, in the present embodiment, since it is possible to discharge and use only a using amount from the discharge port 18*a* without using the cosmetic material brush, in the case that the volatile component is much included in the cosmetic material M, it is possible to easily apply the cosmetic material M while protecting.

In this case, the outer filling tube 10 and the inner filling tube 11 can be simultaneously formed by a two-color different material molding machine. In the same manner, the inner filling tube 11 and the pen point member 12 can be simultaneously formed by the two-color different material molding machine. Accordingly, it is possible to simplify the manufacturing of the cosmetic material applying container 100.

The description will be given above of the preferable embodiment according to the present invention, however, the present invention is not limited to the embodiment mentioned above, but may be modified within a range which does not change the scope described in each of claims, or may be applied to the other structures.

Figure 13A:
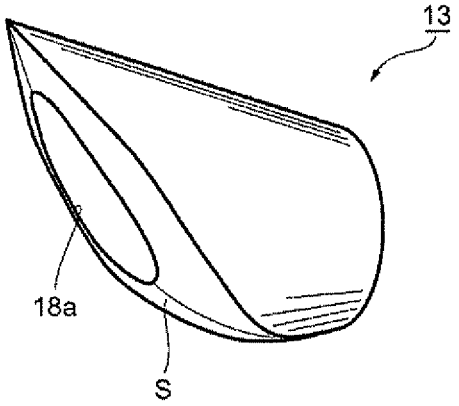
FIG. 13A is a perspective view showing a first modified example of the pen point in the cosmetic material application container in FIG. 1.
Figure 13B:
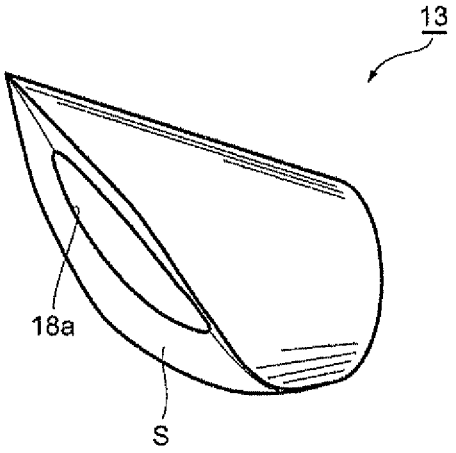
FIG. 13B is a perspective view showing a second modified example of the pen point in the cosmetic material application container in FIG. 1.

For example, in the embodiment mentioned above, the cut surface 58 (refer to FIG. 9) at a time of three-dimensionally forming the pen point 13 is formed as the surface formed by making the curve 57 protrude to both sides in the side direction, however, is not limited to this, but the cut surface 58 may be a surface passing through the curve 57. As an example, the cut surface 58 may be formed as a surface which bulges in a curved surface manner to the leading end side by setting the curve 57 to a peak portion. In this case, as shown in FIG. 13A, the application surface S of the pen point 13 is three-dimensionally formed as such a shape as to bulge to the leading end side in the curved surface manner by setting a portion corresponding to the curve 57 to a ship's bottom. As another example, the cut surface 58 may be formed as such a surface as to bulge to the base end side in the curved surface manner by setting the curve 57 to a peak portion. In this case, as shown in FIG. 13B, the application surface S of the pen point 13 is three-dimensionally formed as such a shape as to depress to the base end side in a curved surface manner by setting the portion corresponding to the curve 57 to a ship's bottom.

Figure 14:
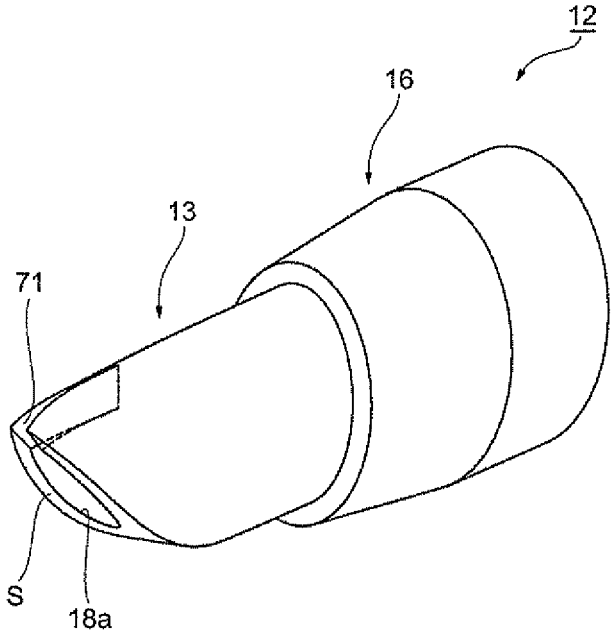
FIG. 14 is a perspective view showing a third modified example of the pen point in the cosmetic material application container in FIG. 1.

Further, as shown in FIG. 14, the pen point 13 may have a slit 71 which extends in an axial direction and is open to the application surface S, in a side corresponding to the peak P (refer to FIG. 3) in the long axis direction A in the peripheral wall of the leading end portion thereof. The slit 71 is formed in such a manner as to be expanded toward the leading end side. In this case, it is possible to preferably retain and discharge the cosmetic material M having a low viscosity.

Figure 15:
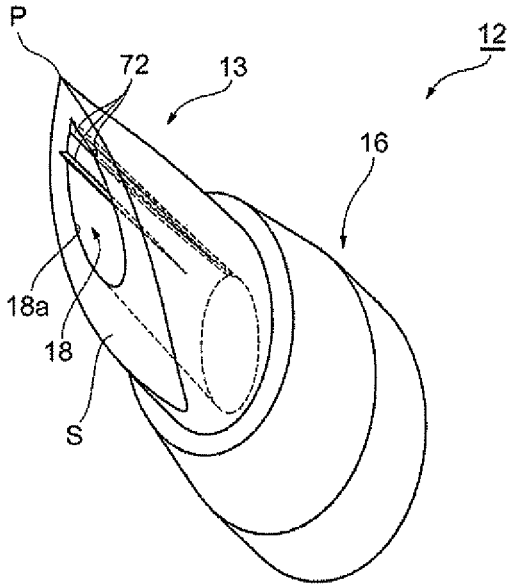
FIG. 15 is a perspective view showing a fourth modified example of the pen point in the cosmetic material application container in FIG. 1.

Further, as shown in FIG. 15, the pen point 13 may have a groove 72 which extends in an axial direction and is open to the application surface S, in a side corresponding to the peak P in the long axis direction A in the inner surface of the through hole 18 in the leading end portion thereof. The groove 72 is formed in such a manner that a depth thereof becomes deeper toward a leading end side. In this case, it is also possible to preferably retain and discharge the cosmetic material M having the low viscosity.

Further, in the embodiment mentioned above, the peak P is three-dimensionally formed in the leading end of the application surface S of the pen point 13 by forming the sharp portion 53 in the leading end shape 52, however, is not limited to this. The peak P may be formed in the leading end of the application surface S by an after processing.

Further, the embodiment mentioned above is structured such as to move the moving body 6 and the piston 7 on the basis of a relative rotation between the main body tube 2 (the container front portion) and the operation tube 3 (the container rear portion), however, may be a container which moves the moving body 6 and the piston 7 by a knock mechanism. Further, it may be a container in which an inner cotton impregnated with the cosmetic material M is provided within the filling member 1, and the cosmetic material M is discharged from the discharge port 18*a* of the pen point 13 on the basis of a capillary phenomenon by a relay core. Further, it may be a container which discharges the cosmetic material M from the pen point 13 on the basis of a capillary phenomenon by using a bellows-like regulating mechanism.

Further, the curve 57 (refer to FIG. 8) set at a time of three-dimensionally forming the pen point 13 is drawn so as to pass through the base end side of the side surface of the flat circular column 54 on the plane 55, however, is not limited to this. The curve 57 may have various loci as long as it is formed as an arcuate shape which is inclined while heading for the base end side from one intersecting point 56 and extends so as to bulge to the leading end side.

Further, the present invention can be, of course applied to a cosmetic material application container using the cosmetic material M, for example, a lip stick, an essence, a cleaning fluid, a nail enamel, a nail care solution, a nail remover, a mascara, an anti-aging material, a cosmetic material for hair, an oral care material, a massaging oil, a keratotic plug removing fluid, a foundation, a skin cream, an ink for a writing instrument such as a marking pen or the like, a liquid drug, a slurry material or the like.

Further, the external thread and the internal thread mentioned above may be constructed by any means which serves the same function as a thread ridge and a thread groove such as a projection group arranged intermittently, or a projection groove arranged spirally and intermittently, in addition to the thread ridge and the thread groove. The term "center" mentioned above include an approximately center, and intends to an extended meaning allowing a predetermined deflection and displacement.

Further, in the embodiment mentioned above, the term "flat" is based on the flat circular shape such as the oval, the ellipse or the like in which the circle is deformed flat (flattened), and the leading end shape 52 is formed as the drop shape having the sharp portion in which the oval is changed, however, in the flat shape according to the present invention, it is possible to select an elongated oval leaf shape, a cats-eye elongated shape, and an approximately polygonal shape such as an approximately triangular shape, an approximately pentagonal shape, an approximately hexagonal shape and the like, in which the flat circular shape is further changed.

Figure 16:
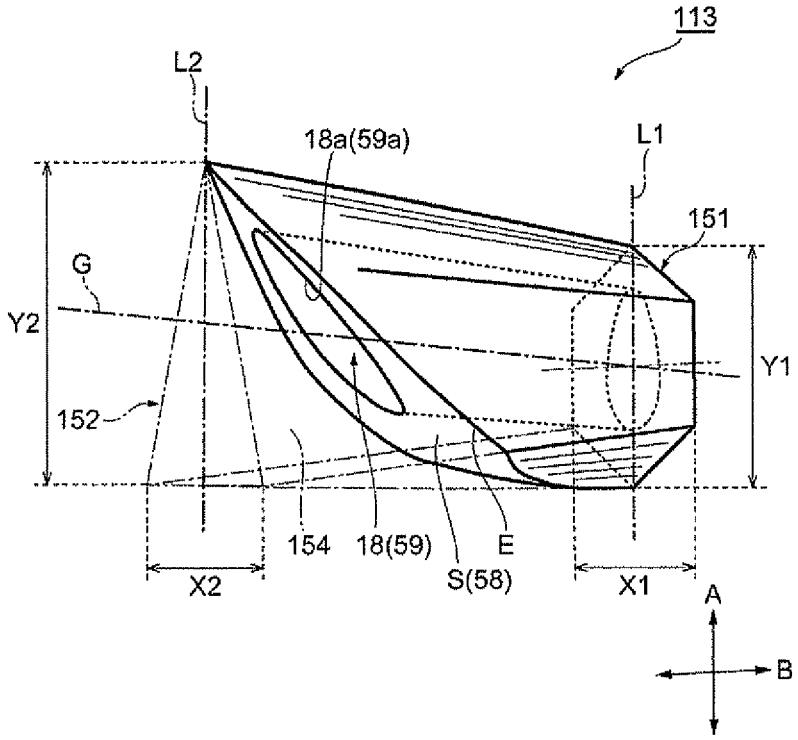
FIG. 16 is a perspective view showing a fifth modified example of the pen point in the cosmetic material application container in FIG. 1.

For example, as shown in FIG. 16, a base end shape 151 may be a flat shape having a long side Y1 and a short side X1, a leading end shape 152 may be a flat shape having a long side Y2 and a short side X2, and a flat columnar body 154 may be a flat column body which is formed by connecting the base end shape 151 and the leading end shape 152 and in which an outer shape of a transverse cross section has a short side and a long side. Further, as shown in the drawings, the flat column body 154 may be structured by the base end shape 151 which has a peak and is formed as an elongated approximately hexagonal shape, and the leading end shape 152 which is provided closer to the leading end side than the base end shape 151, has a peak and is formed as an elongated approximately triangular shape, a curved surface shaped application surface may be structured so as to further bulge to the leading end side, and a shape of the pen point 113 may be three-dimensionally formed.

The entire disclosure of Japanese Patent Application No. 2010-213707 filed Sep. 24, 2010, is expressly incorporated by reference herein.

What is claimed is:

1. A cosmetic material application container discharging a cosmetic material filled in a filling region within the container from a pen point portion formed by a soft material, wherein a shape of said pen point portion is three-dimensionally formed by structuring a flat column body by a base end shape forming a flat shape, and a leading end shape provided closer to a leading end side than said base end shape and forming a flat shape, wherein an arcuate curve is inclined toward a base end side from one intersecting point between an outer edge of said leading end shape and a long axis of said leading end shape as to bulge to the leading end side, on a plane including a long axis of said base end shape and the long axis of said leading end shape in said column body, wherein said column body is cut by a cut surface passing through said curve to form an application surface defined by the cut surface passing through the arcuate curve, and wherein said flat column body includes a tapered shape such that a length of a short axis of said leading end shape is shorter than a length of a short axis of said base end shape.

2. A cosmetic material application container discharging a cosmetic material filled in a filling region within the container from a pen point portion formed by a soft material, wherein a shape of said pen point portion is three-dimensionally formed by structuring a flat column body having a base end shape forming a flat shape, and a leading end shape provided closer to a leading end side than said base end shape and forming a flat shape, wherein an arcuate curve is inclined toward a base end side from one intersecting point between an outer edge of said leading end shape and a long axis of said leading end shape as to bulge to the leading end side, on a plane including a long axis of said base end shape and the long axis of said leading end shape in said column body, wherein a line of intersection is set between a cut surface passing through said curve and said column body to an outer edge of the leading end surface and to said base end shape, and wherein an application surface is defined by a sectional region of the column body by the line of intersection, and wherein said flat column body includes a tapered shape such that a length of a short axis of said leading end shape is shorter than a length of a short axis of said base end shape.

3. A cosmetic material application container as claimed in claim 1 or 2, wherein a portion corresponding to said one intersecting point in said leading end shape is sharper than a portion corresponding to another intersecting point between the outer edge of said leading end shape and the long axis of said leading end shape.

4. A cosmetic material application container as claimed in claim 1 or 2, wherein said cut surface three-dimensionally forms an elongated application surface in which a direction along an axial direction of said pen point portion is set to a longitudinal direction, and a peak is formed in a leading end of said application surface.

5. A cosmetic material application container as claimed in claim 1 or 2, wherein said pen point portion has a discharge port which is formed in a center in the leading end surface of said flat column body cut by said cut surface, as seen from the leading end side.

6. A cosmetic material application container discharging a cosmetic material filled in a filling region within the container from a pen point portion formed by a soft material, wherein said pen point portion is formed as an edge shape while an outer shape of a transverse surface being formed as a flat circular shape, a leading end surface thereof structures an application surface defined by the transverse surface, said application surface includes a curved shape as to bulge to a leading end side, and a peak is formed in a leading end of said application surface, and wherein the pen point portion includes a taper surface which is inclined so as to be tapered to the application surface and which is formed in a region running into the base end side at a predetermined length from an outer edge of the application surface in both side surfaces of the pen point.

7. A cosmetic material application container for discharging a cosmetic material filled in a filling region within the container from a pen point portion formed by a soft material, wherein said pen point portion is formed as an edge shape while an outer shape of a transverse surface being formed as flat circular shape, a leading end surface thereof structures an application surface defined by the transverse surface having a tapered shape such that a length of a short axis of the leading end surface becomes shorter in accordance with coming to a leading end side, said application surface includes a curved shape as to bulge to the leading end side, and wherein the pen point portion is formed at one side of the leading end side, as a sharp portion which is sharpened at an acute angle, and a peak is formed in a leading end of said application surface, said peak defining the sharp portion of the pen point portion.

* * * * *